United States Patent [19]

Keller

[11] 3,990,356

[45] Nov. 9, 1976

[54] METHOD OF AND APPARATUS FOR CONTROLLING THE INLET OPENINGS OF CENTRAL VENTILATION INSTALLATIONS

[76] Inventor: Hans Rudolf Keller, Ueberlandstrasse 461, Zurich, Switzerland

[22] Filed: Feb. 4, 1975

[21] Appl. No.: 546,995

[30] Foreign Application Priority Data

| | | |
|---|---|---|
| Feb. 18, 1974 | Switzerland | 2245/74 |
| June 20, 1974 | Switzerland | 8474/74 |
| Oct. 30, 1974 | Switzerland | 14555/74 |

[52] U.S. Cl. ..... 98/43 A; 251/11

[51] Int. Cl.[2] ..... F24F 7/06

[58] Field of Search ..... 98/43 A, 42, 33 R, 32, 98/19; 4/209; 240/2 V; 251/11

[56] References Cited

UNITED STATES PATENTS

| | | | |
|---|---|---|---|
| 576,718 | 2/1897 | Bolton | 98/33 R X |
| 3,188,937 | 6/1965 | Mieczkowski | 98/43 A |
| 3,307,469 | 3/1967 | Bohanon | 98/43 A X |
| 3,860,169 | 1/1975 | Norman | 251/11 X |

*Primary Examiner*—William E. Wayner
*Assistant Examiner*—William E. Tapolcai, Jr.
*Attorney, Agent, or Firm*—Karl W. Flocks

[57] ABSTRACT

A method of and apparatus for controlling the inlet or exhaust openings of central ventilation or exhaust installations wherein air is only removed from the individual rooms or areas by means of a central exhaust ventilator when such rooms or areas are in use as well as for a certain time duration thereafter, and after expiration of such time duration the exhaust openings of the rooms or areas are automatically closed.

29 Claims, 4 Drawing Figures

METHOD OF AND APPARATUS FOR CONTROLLING THE INLET OPENINGS OF CENTRAL VENTILATION INSTALLATIONS

BACKGROUND OF THE INVENTION

The present invention relates to a new and improved method of controlling the inlet openings of central exhaust or ventilation installations and also pertains to apparatus for the performance of the aforesaid method.

Such exhaust or ventilation installations are used for the artificial ventilation of rooms or areas, hereinafter simply referred to as rooms, in apartment buildings, hotels, office buildings, industrial complexes and factories and so forth, for instance for the ventilation of inside bathrooms, toilets and the like.

There are already known to the art central exhaust or ventilation installations wherein the central ventilator is turned-on only a number of times each hour for short periods. Such switching of the central ventilator is associated with the advantage that the heating costs for the building in the winter can be appreciably reduced in contrast to systems employing continuous operation of the ventilator, because less hot air is removed. Yet the drawback of such type installations resides in the fact that during the inoperative periods of the ventilator there can prevail unpleasant odors in the vented rooms.

There are also separate exhaust ventilators which can be installed in the individual rooms and switched on and off in such a way that they only run when the light is burning in the associated room as well as still for about five minutes after turning off the light. Such ventilators result in significantly lower heating costs in the winter because they are only then in operation when they are actually needed. It is for this reason that they are increasingly installed in bungalows and single family dwellings. However, in the case of large structures they are rarely used because in this environment the installation costs for a central exhaust installation is considerably less.

In summation it can be stated that the state-of-the-art has taught, on the one hand, central exhaust or ventilation installations which owing to the continuous operation in winter markedly increase the heating costs of the structure or building due to the constant removal or sucking-off of heated air and, on the other hand, intermittently operating central installations wherein individual rooms are periodically not ventilated when in fact they should be ventilated. At the present time, there is no central exhaust or ventilation installation available by means of which air is always only removed at that location where it is necessary to do so.

SUMMARY OF THE INVENTION

Hence, it is a primary object of the present invention to provide an improved method of and apparatus for the control of the inlet openings of central exhaust installations in a manner not associated with the aforementioned drawbacks and limitations of the prior art proposals.

In consideration of the above-discussed state-of-the-art it is a further significant object of this invention to control the exhaust openings of central exhaust or ventilation installations in such a manner that at the individual rooms air is only then sucked-off when it is necessary to do so.

In the case of residential buildings and hotels having inside bathrooms and toilets it is therefore possible for instance to reduce the heating costs by about 10% to 40%, because hot air is not continually sucked-off and replaced by outside air which penetrates into the rooms at the regions of the windows and doors and which outside air must be heated-up.

Now in order to implement the foregoing objects and others which will become more readily apparent as the description proceeds, the method aspects of this development is manifested by the features that at the individual rooms air can only be removed or sucked-off by a central exhaust ventilator when such rooms are used as well as for a short period of time thereafter, and after expiration of such time period the exhaust openings of the rooms are automatically closed. The central ventilator thus operates without interruption, yet the exhaust openings of the individual vented rooms are only opened when the corresponding room is used as well as during an adjustable time span, for instance amounting to 5 minutes, upon leaving such room.

As explained heretofore the invention is also concerned with apparatus for carrying out the method and which apparatus comprises a control element which acts via an adjustment element upon a shut-off element in the exhaust opening associated with the room, the shut-off element can be opened and closed against the action of a restoring device.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
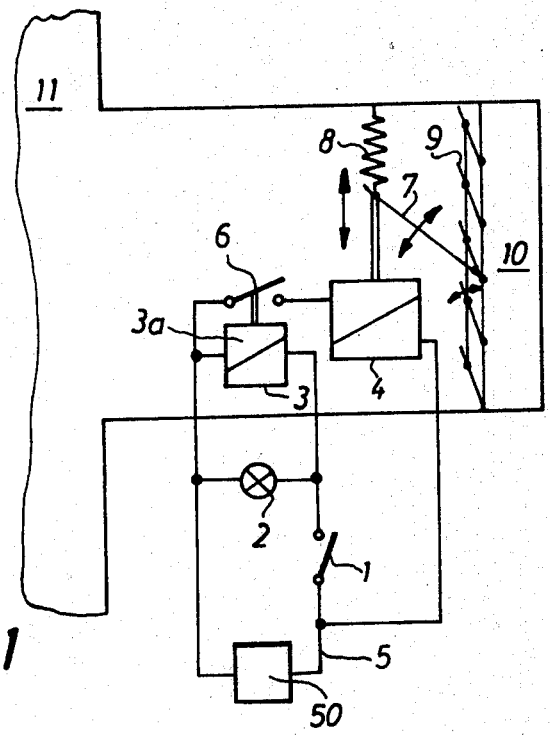
FIG. 1 is a schematic circuit diagram of the control for the exhaust opening of a room as contemplated by the invention.

Considering now the drawings it is to be understood that only enough of the details of the ventilation system has been shown to enable those skilled in the art to readily understand the underlying concepts of this development. Turning attention to FIG. 1 it is to be appreciated that reference character 1 denotes a light switch of a room or area, hereinafter simply referred to as a room, which is to be ventilated. The light switch 1 is in circuit with a suitable power supply, generally indicated by reference character 50. Light switch 1 constitutes a control element and is electrically coupled with the room lighting system 2 and a relay 3 which releases or de-energizes with a certain time delay. A lifting magnet 4 is coupled on the one hand with a current conductor 5 and on the other hand with a switch or contact 6 of the relay 3 operating with the aforementioned time delay. For brevity relay 3 will be sometimes referred to hereinafter simply as time-delay relay 3. The relay 3 and the therewith operatively coupled lifting magnet 4 constitute an adjustment element or adjustment means. A lever 7 or equivalent structure is connected with the lifting magnet 4, a return spring 8 as well as a shut-off element 9 of the exhaust or inlet opening 10 of the room which has not been particularly provided with a reference character.

If the contact of the light switch 1 is closed, then the room illumination of lighting system 2 of the room to be ventilated is switched-on. At the same time the contact 6 of the time-delay relay 3 is closed, so that the lifting magnet 4 moves the lever 7 such that the shut-off or closure element 9 of the exhaust or inlet opening 10 is opened. Now the central exhaust ventilator, such as ventilator 12 shown in FIG. 2, can suck-off or remove air out of the room via the collecting channel or duct 11. If the room lighting system 2 is again turned-off by opening the light switch 1 then the contact 6 of the time-delay relay 3 still remains closed for some time owing to the de-energization delay of such relay. Only after expiration of such de-energization delay time, which can amount to for instance 5 minutes, does the contact 6 open, so that the lifting magnet 4 no longer draws current. The restoring or return spring 8 now moves the lever 7 such that the shut-off element 9 of the exhaust opening 10 is again closed. Consequently, the central exhaust ventilator no longer can suck-off air out of the corresponding room.

Figure 2:
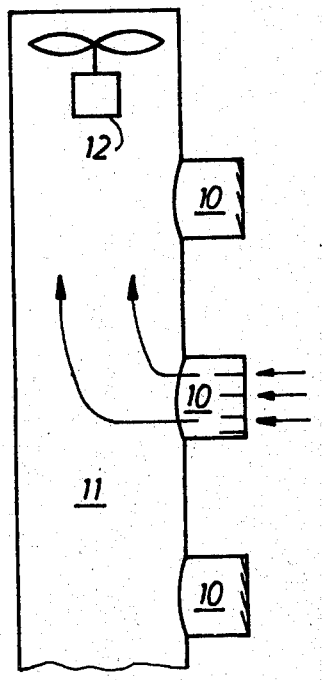
FIG. 2 schematically illustrates the construction of a central exhaust or ventilation installation according to a first embodiment of the inventive apparatus.

FIG. 2 illustrates schematically the construction of a central exhaust or ventilation installation wherein the central exhaust ventilator 12 sucks-up air via the collecting channel or duct 11. Of the three illustrated exhaust openings 10 only one is in its open state, so that air can be sucked-off. Both of the other exhaust or inlet openings are closed, so that at these locations no air can be sucked-off.

FIGS. 1 and 2 respectively show the circuit diagram and the construction of the equipment for venting a room while using a relay 3 having a de-energization time-delay; for instance, relay 3 may be equipped with a time-delay component 3*a* which can be constituted by an electronic time-delay circuit or a mechanical time-delay device. Instead of using the relay three could be also employed an electronic direct-current circuit or mechanical solution for the retardation of the closing of the exhaust opening. Additionally, in the exemplary illustrated embodiment the pulse of the light switch 1 is used as the signal for the opening of the shut-off element and thus the exhaust opening and also for delaying the reclosing of such exhaust opening. Instead of using a light switch it would be also possible to employ a different signal source for the room, for instance a light barrier arrangement typically embodying a light source and photocell, the current for operating a machine and so forth.

Figure 3:
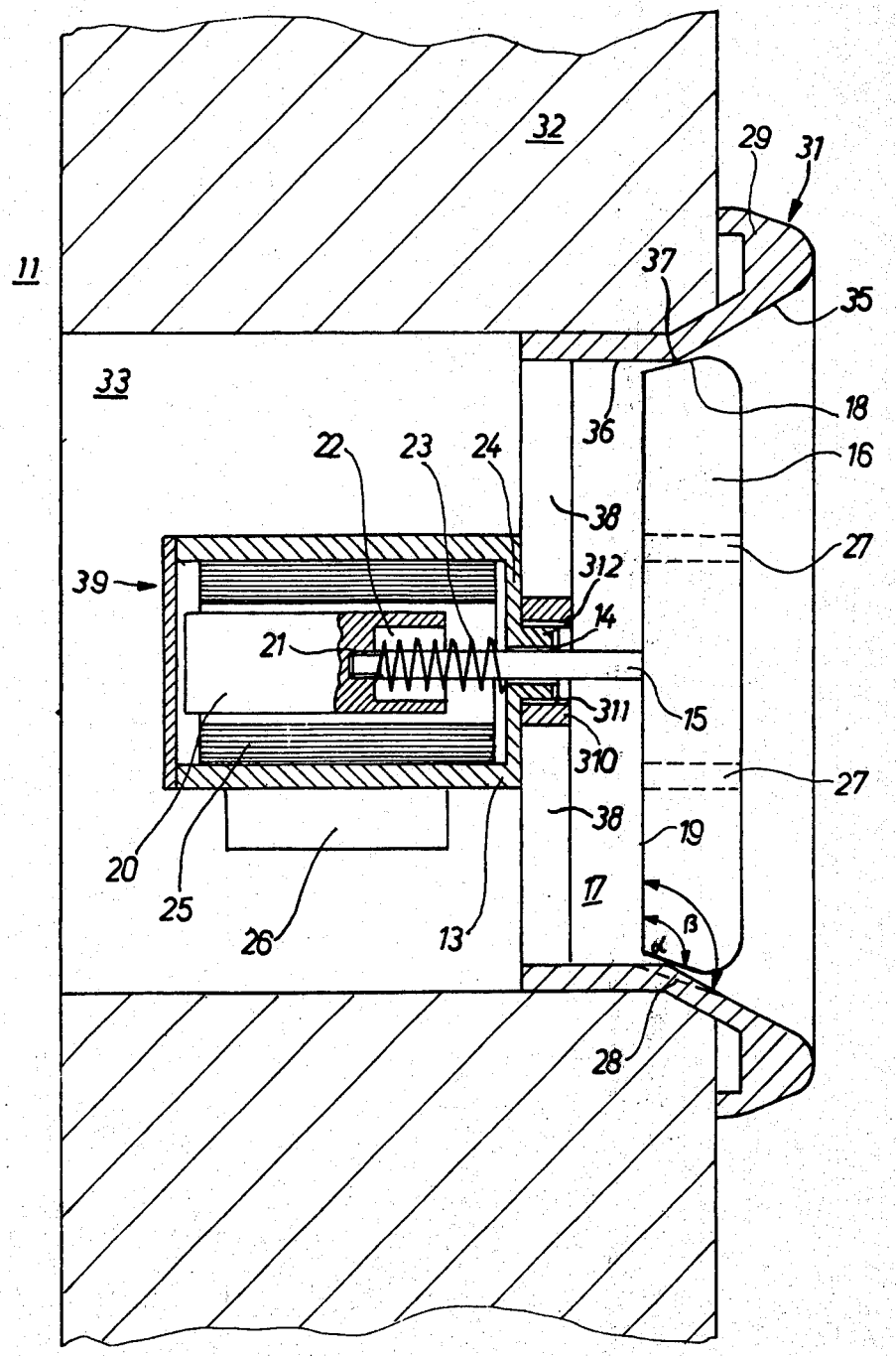
FIG. 3 illustrates in sectional view details of a further exemplary embodiment of apparatus according to the invention.

A further exemplary embodiment of the apparatus for the performance of the method aspects of this invention is illustrated by way of example in FIG. 3. It will be seen that such apparatus comprises a circular frame 31 which is mounted in a channel or duct 33 formed in the wall 32 of a room which is to be ventilated. The other end of the duct or channel 33 opens into the collecting channel 11 in which there is located the central exhaust ventilator 12 as previously discussed in conjunction with FIG. 2.

The inner wall of the frame 31 possesses a substantially conical section or portion 35 followed by a substantially cylindrical-shaped section or portion 36, so that there is formed an edge 37 at the transition location of these two portions 35 and 36 of the frame 31.

The end of the cylindrical section or portion 36 which faces away from the edge 37 possesses ribs or struts 38 which carry a lifting magnet 39 serving as an actuation mechanism or device for the shut-off or closure element 16 which will be described in greater detail hereinafter. The central ends of the ribs or struts 38 are interconnected by means of a hub 310, the inner wall of which is provided with threading 311. Threaded into the hug 310 is a threaded connection or insert 312 which protrudes from the end wall 24 of the housing 13 of the lifting magnet 39. The threaded connection or insert 312 is provided with a bore 14 in which there is mounted with play an actuation rod 15.

Actuation rod 15 is connected at one end with the shut-off or closure element constructed as a closure body member 16 for the exhaust or inlet opening 17, and wherein such exhaust opening 17 is bounded by the inner wall of the frame 31. The shut-off body member 16 is constructed as a round i.e., a circular-shaped or an elliptic plate member, the side wall 18 of which likewise possesses a conical configuration. However, the $\alpha$ which the side wall 18 encloses with the rear larger wall 19 of the shut-off or closure body member 16 is smaller than the angle $\beta$ which is enclosed between the rear larger wall 19 of the shut-off body 16 and the conical portion 35 of the inner wall of the frame 31. As a result there prevails a line contact along the edge 37, defining a sealing edge, between the frame 31 and the shut-off body member 16, this line contact insuring for a good, noise-free closure of the exhaust opening 17 and which can be obtained with minimum expenditure in force.

The other end of the actuation rod 15 is connected with the core 20 of the electro-magnet defining the lifting magnet 39. This end of the actuation rod 15 can be either rigidly connected with the core 20 or with the aid of a threading 21. The core 20 possesses a recess or cavity 22 in which there is supported one end of a restoring or return spring 23, the other end of such return spring 23 bearing against the inside of the right-hand located end wall 24 of the lifting magnet 39.

The core 20 is surrounded by the winding 25 of the lifting magnet 39. At the housing 13 of the lifting magnet 39 there is arranged a relay 26 with de-energization time-delay and which relay constitutes the second component of the adjustment element. For the sake of brevity relay 26 likewise will be conveniently referred to sometimes hereinafter as time-delay relay. This time-delay relay 26 controls the lifting magnet 39 and serves as means for the time-delayed shutting-off of the actuation device 39 i.e. lifting magnet. This relay 26 is actuated by a control element which, as previously explained, can be constituted as a switching contact which is typical for the room to be vented, for instance can be a light switch which is here not shown but comparable to the light switch 1 of FIG. 1.

Having now had the benefit of the foregoing description the mode of operation of the apparatus portrayed in FIG. 3 will be considered and is as follows:

The automatic opening operation of the relevant exhaust opening or inlet opening is brought about through actuation of a suitable control element which, as explained heretofore, may be constituted by a light switch, a light barrier arrangement, a foot contact or another switch contact which can be typically found or arranged in the relevant room. Upon actuation of the switching contact i.e. control element the time-delay relay 26 is supplied with voltage, whereby immediately also the winding 25 of the lifting magnet 39 has applied thereto the voltage. The core 20 of the lifting magnet 39 is displaced towards the right against the action of the return spring 23, whereafter the shut-off body members 16 opens the exhaust or inlet opening 17. In this way there is rendered possible the sucking-off or removal of air through the exhaust opening 17 out of the room to be vented by means of the central exhaust ventilator 12 as shown in FIG. 2.

After interrupting i.e., again opening the switching contact or control element which is typical for the room to be vented at the relay 26 there begins to run the de-energization retardation time, in other words, the time-delay of the relay comes into play. After expiration of such time-delay the relay 26 interrupts the current supply to the winding 25 of the electro-magnet constituted by the lifting magnet 39, and the core 20 is biased towards the left by the action of the return spring 23 and therefore also the shut-off body member 16 comes into operable coaction or engagement with the sealing edge 37 of the frame 31. Any further sucking-off of air out of the aforementioned room is thus prevented in this manner.

However, in the event that it is desired to insure that even after expiration of the time-delay of the relay 26 there is still withdrawn a certain minimum quantity of air, then it is possible to either provide the shut-off or closure body member 16 with bores or throughpassages 27 and/or the frame 31 with grooves or channels 28. These grooves 28 can be milled for instance in the finished frame 31 or can be formed during the manufacture thereof. If desired, both measures as explained above could be used.

The exhaust opening 17 can be held open during use of the room not only by means of a lifting magnet, rather also by means of an electric motor, a pneumatic circuit or the like. The time-delay for the dropping-off or de-energization of the relay can be carried out electronically, electro-magnetically, mechanically, thermally or pneumatically. It is further conceivable to have the shut-off body member 16 re-close also under the action of the force of gravity.

As a variant of the invention it would be possible to only maintain the exhaust opening 17 in its open condition during such time as the room is being used and to again immediately close the same after such room is no longer used, that is to say, to dispense with the time-delay circuit.

If required it is possible to adjust the maximum quantity of air which is exhausted. This can be achieved in that the actuation rod 15 is threaded to a greater or lesser extent into the core 20 of the electro-magnet i.e. lifting magnet 39, and for which purpose the rear surface of the core 20 can be then provided with a slot for the application of a screw driver or other suitable tool. A second possiblity would be to thread the threaded connection or insert 14 at the lifting magnet 39 to a greater or lesser extent into the hub 310. Of course, both of these possibilities could be conjointly used.

The frame 31 could also be constructed without the collarshaped edge 29, so that the outer wall of the frame is cylindrical and the entire device can be accommodated in the channel or duct 33.

Figure 4:
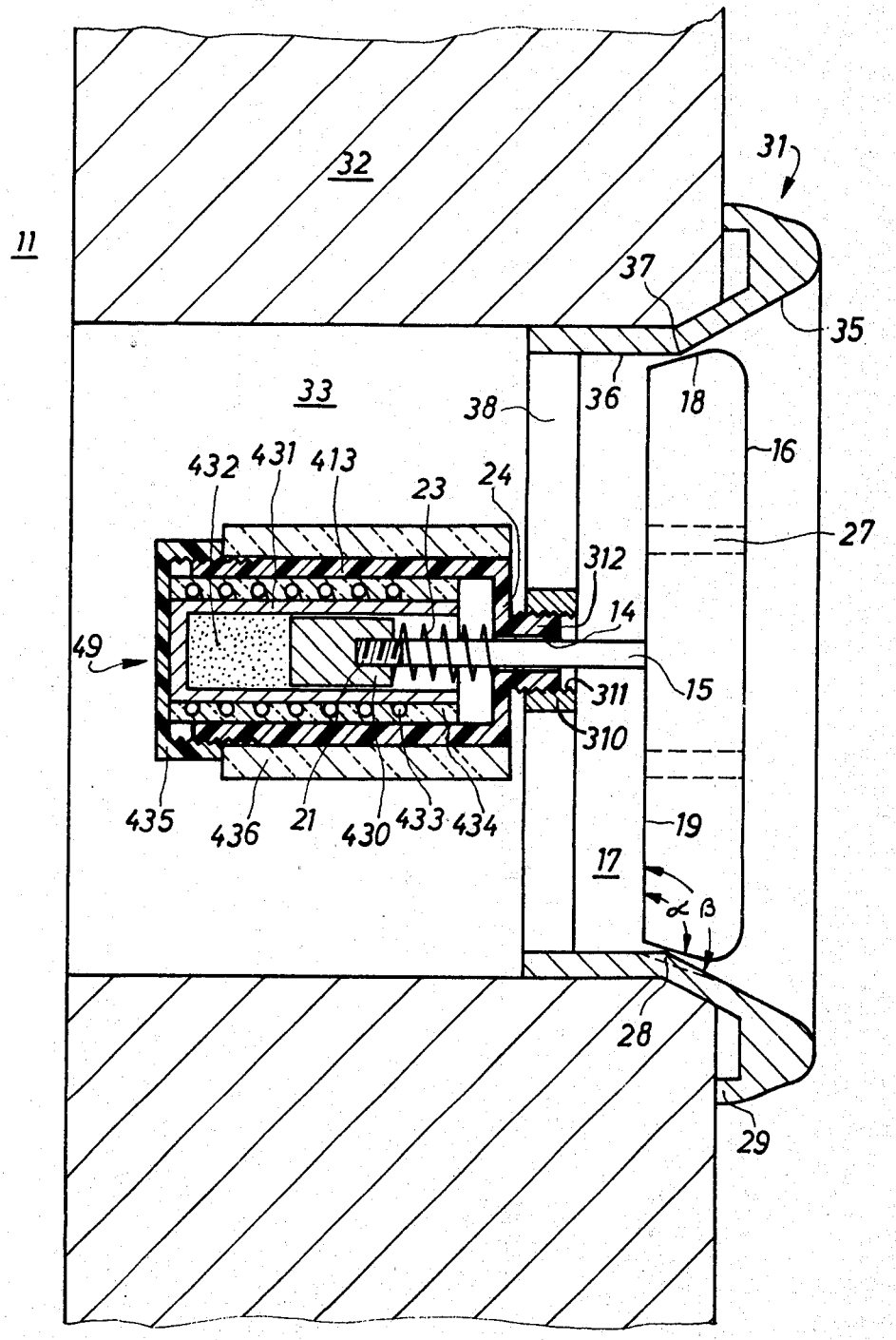
FIG. 4 is a sectional view, similar to the showing of FIG. 3, of still a further exemplary embodiment of inventive apparatus.

In FIG. 4 there is shown a modified embodiment of the arrangement of FIG. 3 and wherein for convenience generally the same reference characters have been employed to denote the same elements. In the apparatus structure shown in FIG. 4 the same differs from that shown in FIG. 3 primarily in the features that instead of using a lifting magnet there is employed a lifting mechanism 49 equipped with an expansible element 432.

The lifting mechanism or device 49 possesses a piston 430. This piston 430 is located in a sleeve 431 formed for instance of copper. The internal compartment of the sleeve 431 which is closed by the piston 430 is filled with the expansible element 432. This expansible element 432 can be either a solid material, a liquid, for instance fluoro-chloro-hydrocarbons (and this term is intended to include those organic compounds where all hydrogen atoms are replaced by halogen atoms), or however also a gas. The sleeve 431 is at least partially surrounded by an electrical heating element 433 which is connected through the agency of a control element, for instance via a light switch (not here shown) of the room to be vented with a supply source, such as the power or energy supply sourse 50 shown in FIG. 1. The winding of the heating element 433 is embedded in an electrically insulating material 434. The thus assembled group of components is located in a housing 413 which is closed by means of a cover 435.

If necessary the housing 413 can be provided with a body 436 formed of a thermally insulating material, the significance of which will be discussed more fully hereinafter.

One end of the actuation rod 15 is connected with the piston 430 of the lifting mechanism 49. This end of the actuation rod 15 can be either rigidly connected with the piston 430 or by means of the threading 21. Bearing at the piston 430 is one end of the return spring 23 serving as the return or restoring device, the other end of return spring 23 bearing against the inside of thr right-hand located end wall 24 of the lifting mechanism 49. The restoring device however can also be of the type which becomes effective at underpressure.

The mode of operation of the just-described embodiment of apparatus is as follows:

Upon actuation of the switching contact or control element typical for the relevant room to be vented current is delivered to the heating element 433, so that such can transfer heat to the expansible element 432. Under the action of this heat the element 432 expands and brings about movement of the piston 430 towards the right against the action of the return spring 23 and that the shut-off or closure body member 16 opens the exhaust or inlet opening 17. In this way it is possible for the central exhaust ventilator 12 shown in FIG. 2 to suck-off air out of the room to be vented through the exhaust opening 17.

After opening the switch contact which is typical for the room to be vented the supply of current to the heating element 433 is interrupted. Consequently, the heating element 433 no longer generates any heat and from this point in time in lifting mechanism or device 49 begins to loose the previously received heat. As a result also the expansible element 432 looses its heat, so that it gradually assumes its previous dimensions, and the piston 430 is moved towards the left into its rest position under the action of the return spring 23. At the same time there also occurs the shutting-off of the exhaust opening 17 by means of the shut-off or closure body member 16 which again bears against the sealing edge 37.

The duration of time-span which expires between shutting-off of the electrical current and the closing of the opening 17, among other things is also dependent upon the speed with which the lifting mechanism 49 cools-off. In the event it is desired to obtain longer delay times, for instance 5 to 10 minutes, then the aforementioned body 436 formed of a heat insulating material can be arranged at the housing 413 of the lifting mechanism. The greater amount of material which this body 436 possesses that much slower is the delivery of heat and thus there can be obtained longer delay times. With the aid of the previously described exemplary embodiment of the lifting or lift mechanism 49 there can be attained delay-times in the order of 30 seconds to 10 minutes. Naturally, there also occurs a delay in the response of the lifting mechanism with respect to the point in time of switching-in the heating current. This switching-in time-delay is in the order of magnitude between 10 to 120 seconds, constituting a practically insignificant time-delay. The switching-in time delay in comparison to the aforementioned switching-off time-delay is so small because the heating element 433 is located very close to the expansible element 432. The lifting mechanism or device 49 on the other hand only then closes the exhaust opening when the temperature thereof in its entirety has sufficiently dropped, and the mass of the entire lifting mechanism 49 functions as a heat storage.

At the individual rooms which are to be ventilated or exhausted the exhaust opening is only held open when the rooms are used as well as for a certain amount of time thereafter in order to insure for a good post-ventilation. The exhaust openings of the rooms which are connected to the central exhaust or ventilation installation but not used at the same point in time of course remain closed.

When necessary it is possible to render adjustable the minimum air quantity and the maximum air quantity which is exhausted. This can be achieved in that the actuation rod 15 is threaded, as desired, to a greater or lesser extent into the piston 430 of the lifting mechanism 49.

It should be understood that the described lifting mechanism is also suitable for the actuation of differently constructed shut-off elements. It can be used for actuating a flap arranged in the exhaust channel and which flap is provided with an axis of rotation at approximately its central region, for instance by providing a rotatable shaft which is mounted at its end in two oppositely situated bearings or supports in the exhaust channel.

As already mentioned heretofore, the automatic opening operation can be initated also, if desired, by means of a light barrier arrangement, a foot contact or another switch contact typical for the relevant room.

The lifting mechanism 49 can also be constructed in such a manner that the actuation rod 15 merely bears against the piston 430. The end portion of the actuation rod 15 bearing at the piston 430 then possesses a plate against which bears the return spring 23.

Additionally, it is conceivable to group together the individual components 413, 433, 434 and 435 of the lifting mechanism 49 into a single element in that the heating element 433 is embedded in a casting resin. If the quantity of the casting mass is selected to be sufficiently great, then it is possible to attain time-delays which considerably exceed the previously mentioned 10 minutes.

For regulating the exhaust suction there is necessary only an axial movement (thrust or traction) with only one moved apart or component and restoring spring. The exhaust opening is maintained round or circular and the sealing location only has line contact, as previously discussed. As a result from the standpoint of manufacturing the sealing location it can be simply fabricated and there hardly occur whistling noises with closed exhaust opening. The maximum air quantity can be varied in a simple manner by limiting the stroke of the shut-off or closure body member. A minimum quantity of air, with the apparatus not activated, can be readily realized through the provision of bores or grooves in the closed condition of the equipment and by varying the number and/or size thereof.

Further advantages of the described method as well the described apparatus for controlling the inlet or exhaust openings of central exhaust installations are the following:

There do not exist any vacuum problems in rooms with tightly closed windows, i.e., owing to the negative pressure produced by the suction action the doors no longer cleanly close or can be hardly opened. A further advantage resides in the fact that in summer climatic conditions there can be obtained a more comfortable room climate because with outside temperatures considerably less air is sucked into the building. Consequently, the room temperature remains lower and therefore more pleasant.

While there is shown and described present preferred embodiments of the invention, it is to be distinctly understood that the invention is not limited thereto, but may be variously embodied and practiced within the scope of the following claims. Accordingly,

What is claimed is:

1. An apparatus for controlling the exhaust openings of a central exhaust installation for removing air from a number of rooms, each room having at least one of said exhaust openings connected to an air collecting channel in which a central ventilator is placed and which continuously exhausts the air, comprising shut-off means to selectively open and close an exhaust opening from one of the rooms, said shut-off means having an open position and a closed position, restoring means for returning the shut-off means from its open position back to its closed position, adjustment means cooperating with said shut-off means to cause movement of such shut-off means from its closed position to its open position, said adjustment means being placed in said exhaust opening including a time-delay means, and control means for providing adjustment means with a control signal to cause said adjustment means to effect said movement of said shut-off means against the action of said restoring means, said time-delay means of said adjustment means causing said shut-off means to maintain its open position for a certain time duration after disappearance of the control signal from said control means which activates said adjustment means.

2. The apparatus as defined in claim 1, wherein said control means includes means for generating a control pulse constituting said control signal for the relevant room which is occupied in order to bring about the opening of the shut-off means as well as the closing thereof with a time-delay.

3. The apparatus as defined in claim 1, further including a power supply source in circuit with said control means, each room having a light switch for a light and defining the control element, said adjustment means of each room comprising a relay having a time-delayed de-energization response operatively connected with said light switch, a lifting magnet, said relay including a contact for connecting said lifting magnet with the power supply source, said restoring device including a return spring, the shut-off means being arranged in the exhaust opening of the associated room and being opened against the action of said return spring of said restoring device and after interrupting the power supply for the light such shut-off means is still held in its open position for a certain period of time by means of said relay and said lifting magnet.

4. The apparatus as defined in claim 2, wherein said time-delay means comprises an electronic time-delay circuit.

5. The apparatus as defined in claim 2, wherein said time-delay means comprises a mechanical time-delay device.

6. The apparatus as defined in claim 1, wherein said shut-off means comprises s substantially round and axially displaceable shut-off body member located in a frame, said frame possessing a substantially round internal exhaust opening.

7. The apparatus as defined in claim 6, wherein said frame includes an inner wall having a substantially conical portion followed by a substantially cylindrical portion, and at the transition location between said conical portion and cylindrical portion there is provided an edge means, said shut-off body member having an inclined extending side wall which bears at said edge means.

8. The apparatus as defined in claim 6, wherein the outer wall of said frame is substantially cylindrical.

9. The apparatus as defined in claim 6, wherein said frame possesses a substantially collar-shaped edge.

10. The apparatus as defined in claim 6, wherein said shut-off body member is connected via an actuation rod with said adjustment element.

11. The apparatus as defined in claim 10, wherein said adjustment element comprises a lifting magnet having a core connected with said actuation rod.

12. The apparatus as defined in claim 11, wherein said actuation rod is connected by means of threading with said core of lifting magnet.

13. The apparatus as defined in claim 11, wherein the lifting magnet is provided with a housing having end walls, one of the end walls of said housing being provided with a threaded connection, said frame possessing ribs, the central ends of said ribs being interconnected with one another by a hub, and wherein the threaded connection is threaded into said hub.

14. The apparatus as defined in claim 13, wherein said restoring means includes a return spring located between the core of the lifting magnet and an end wall of the housing.

15. The apparatus as defined in claim 1, wherein said adjustment means includes a lifting magnet and means for the delayed shutting-off of said lifting magnet.

16. The apparatus as defined in claim 15, wherein said delayed shutting-off means comprises a relay with delayed de-energization response.

17. The apparatus as defined in claim 1, wherein the adjustment means comprises a lifting mechanism containing an expansible element.

18. The apparatus as defined in claim 17, wherein the lifting mechanism possesses a sleeve in which there is housed the expansible element and a piston which can be acted upon by said expansible element, and a heating element surrounding said sleeve for heating said expansible element.

19. The apparatus as defined in claim 18, wherein the lifting mechanism includes a thermally insulating body.

20. The apparatus as defined in claim 17, wherein said expansible element is constituted by a liquid.

21. The apparatus as defined in claim 20, wherein said liquid is a fluoro-chloro-hydrocarbon.

22. The apparatus as defined in claim 17, wherein said expansible element is constituted by a solid material.

23. The apparatus as defined in claim 17, wherein the lifting mechanism possesses a restoring device which is effective at negative pressure.

24. The apparatus as defined in claim 19, wherein the lifting mechanism possesses a switching-off delay response and the switching-off delay response of the lifting mechanism is adjustable by changing the cooling conditions.

25. The apparatus as defined in claim 24, wherein the change of the cooling conditions is brought about by the mass of the body formed of thermally insulating material.

26. The apparatus as defined in claim 24, wherein the switching-off delay response of the lifting mechanism is adjustable by means of the heating output of the heating element.

27. The apparatus as defined in claim 24, wherein the switching-off delay response of the lifting mechanism is adjustable by means of the heated expansible element.

28. The apparatus as defined in claim 17, further including limiting means for insuring for a fixed minimum opening in an exhaust channel operatively associated with the shut-off element.

29. The apparatus as defined in claim 17, further including limiting means for insuring for a variable minimum opening in an exhaust channel operatively associated with the shut-off means.

* * * * *